US007474187B1

(12) United States Patent
Huang et al.

(10) Patent No.: US 7,474,187 B1
(45) Date of Patent: Jan. 6, 2009

(54) BASE OF AN INDUCTOR

(75) Inventors: George Huang, Yi-Chang Xian (CN); Wisdom Fan, Fu-Zhou (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/108,692

(22) Filed: Apr. 24, 2008

(30) Foreign Application Priority Data

Oct. 6, 2007 (CN) ..... 2007 2 0176954 U

(51) Int. Cl.
*H01F 27/06* (2006.01)

(52) U.S. Cl. ..... 336/65

(58) Field of Classification Search ..... 336/65, 336/83, 198, 212, 220–223; 333/181
See application file for complete search history.

(56) References Cited

U.S. PATENT DOCUMENTS 4,924,200 A * 5/1990 Kitahara et al. ..... 336/65
5,793,273 A * 8/1998 Yamaguchi et al. ..... 336/198
6,078,242 A * 6/2000 Tomita et al. ..... 336/212
6,624,724 B2 * 9/2003 Tomita et al. ..... 333/181

* cited by examiner

*Primary Examiner*—Tuyen T. Nguyen
(74) *Attorney, Agent, or Firm*—Grossman Tucker Perreault & Pfleger PLLC

(57) ABSTRACT

A base of an inductor is provided. The inductor comprises an annular body, which has a hollow shaft portion and a surrounding sensing portion. The base comprises a bottom portion, a recess, and a hanging shelf. The recess is formed on the bottom portion. The hanger comprises a transverse shaft, disposed at the central portion of the hanging shelf and adapted to pass through the hollow shaft. When the lower portion of the hanging shelf is fixed in the recess, at least a portion of the peripheral induction portion of the annular body is adapted to rest in the recess.

6 Claims, 6 Drawing Sheets

BASE OF AN INDUCTOR

This application claims priority to P.R. CHINA Patent Application No. 200720176954.3 filed on Oct. 6, 2007, the disclosures of which are incorporated herein by reference in their entirety.

CROSS-REFERENCES TO RELATED APPLICATIONS

Not applicable.

BACKGROUND OF THE INVENTION

1. Field of the Invention

The present invention relates to a base of an inductor, and particularly, relates to a base of a filter inductor that facilitates the installation of the filter inductor and maintains a certain distance from a coil and an iron core of the inductor.

2. Descriptions of the Related Art

The rapid development of modern science and technologies has resulted in the widespread use of electric appliances and various electronic communication apparatuses. Nowadays, such products are becoming smaller and multifunctional, adding more need for denser and sophisticated electronic elements. In order to obviate the electromagnetic interference (EMI) between the individual electronic elements and the consequent interference with the overall performance of the products, these products all have to be equipped with a filter inductor to filter out the high-frequency noises by means of the electromagnetic induction effect.

As previously described, the modern electronic and communication products are evolving towards miniaturized ones, and the perspective views of an existing filter inductor adopted in these products are depicted in FIGS. 1A, 1B and 1C respectively. FIG. 1A is a perspective view of the bottom portion of the filter inductor, and FIGS. 1B and 1C are perspective front views thereof at the same viewing angle. Particularly, FIG. 1C depicts the inductor with a coil wound thereon.

As shown in FIG. 1A, the inductor 1 is fixed onto a base 101 by inserting fixing pins 103 thereof into the base 101. Also, shown in FIGS. 1B and 1C, when the coil 105 of the inductor 1 is led through the recesses 107, wound on the fixing pins 103 and then soldered thereon, a rugged surface is formed on the base 101 of the inductor 1. Consequently, if the fixing pins 103 on the bottom of the inductor 101 are inserted into the through-holes formed in a printed circuit board (PCB; not shown), the inductor will become unstable. For this reason, the four additional bosses 109 of a certain height have to be formed on the bottom surface to control the height of the base 101. However, although this method may prevent the instability of the inductor 1, the bosses 109 disposed on the four bottom edges of the base 101 inevitably increase the overall height of the inductor 1, thus increasing the size of the inductor 1.

On the other hand, the other side of the base 101 opposite the bottom surface thereof serves as the mounting surface 111 for the inductor 1, which is generally planar. Since the distance that is kept between the iron core 113 and the coil 105 of the inductor cannot be reduced, the overall height of the inductor 1 is further increased indirectly, which contradicts the tendency in this industry towards increasingly miniaturized products. Furthermore, the planar mounting surface 111 may also render the safety distance between the coil 105 and the bottom of the iron core 113 to be relatively short, which is disadvantageous for a normal operation.

Additionally, in the prior art, there are two baffles 115 that are further disposed between the iron core 113 and the coil 105. When the iron core 113 has a smaller size while the coil 105 has a bigger size, it would be difficult to assemble the iron core 113 and the coil 105 together due to the restriction imposed by the two baffles 115. In this case, the coil 105 would form a tight fit with the base 101, leading to a decreased efficiency of the inductor 1.

Furthermore, to meet the requirements of safety regulations, an adequate distance shall be kept between the coil 105 and the bottom of the iron core 113. Generally, a minimum distance of 1.6 mm is required therebetween. However, due to the baffles 115 disposed between the led out coil 105*a* and the iron core 113, the conventional inductor 1 fails to provide such an adequate distance and therefore is deficient in terms of safety performance.

To summarize, the bases of the conventional inductors have an excessively large volume, are unstably fixed and lack an inadequate safety distance between the coil and the iron core. Therefore, it is highly desirable in the art to provide a base of an inductor that allows it to be more stably fixed and to keep a satisfactory safety distance between the coil and the iron core.

SUMMARY OF THE INVENTION

One objective of this invention is to provide a base of an inductor that has a lowered height and decreased overall size, facilitates the fixation by soldering, and enlarges the safety distances for a coil and the bottom of an iron core of the inductor to overcome the disadvantages of the prior art solutions.

A technical solution of this invention is as follows: a base of an inductor, wherein the inductor comprises an annular body with a hollow shaft portion and a peripheral induction portion. The base comprises a bottom portion, a recess, a hanging shelf and at least one fixing pin. The recess is formed on the bottom portion, and at least one inward recess portion is formed on the other side of the bottom portion. The hanging shelf has a transverse shaft portion disposed in a central portion of the hanging shelf and adapted to be inserted in the hollow shaft portion. When a lower portion of the hanging shelf is fixed in the recess, at least one portion of the peripheral induction portion of the annular body extends into the recess. At least one fixing pin extends downward from an interior of the at least one inward recess portion.

Because the fixing pins of this invention are depressed into the bottom portion of the base with an inductor extending into the recess of the base, the structure described above is able to control the overall height of the inductor effectively. Furthermore, an inclined surface defining at least one sidewall of the recess guarantees a safety distances for the coil and the bottom of the iron core, thus enhancing the safety performance of the inductor. The sidewalls in the depression for the fixing pins and the sidewalls of the base cooperate with each other to form an inward recess portion which is reserved as the soldering groove. Thus, the leads of the coil are controlled to not protrude out of the base after being soldered, thereby to effectively control the overall height of the inductor to fulfilling the need for miniaturization. Moreover, the recess further facilitates the installation of the inductor, thus increasing the assembling efficiency and lowering the manufacturing cost.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1A:
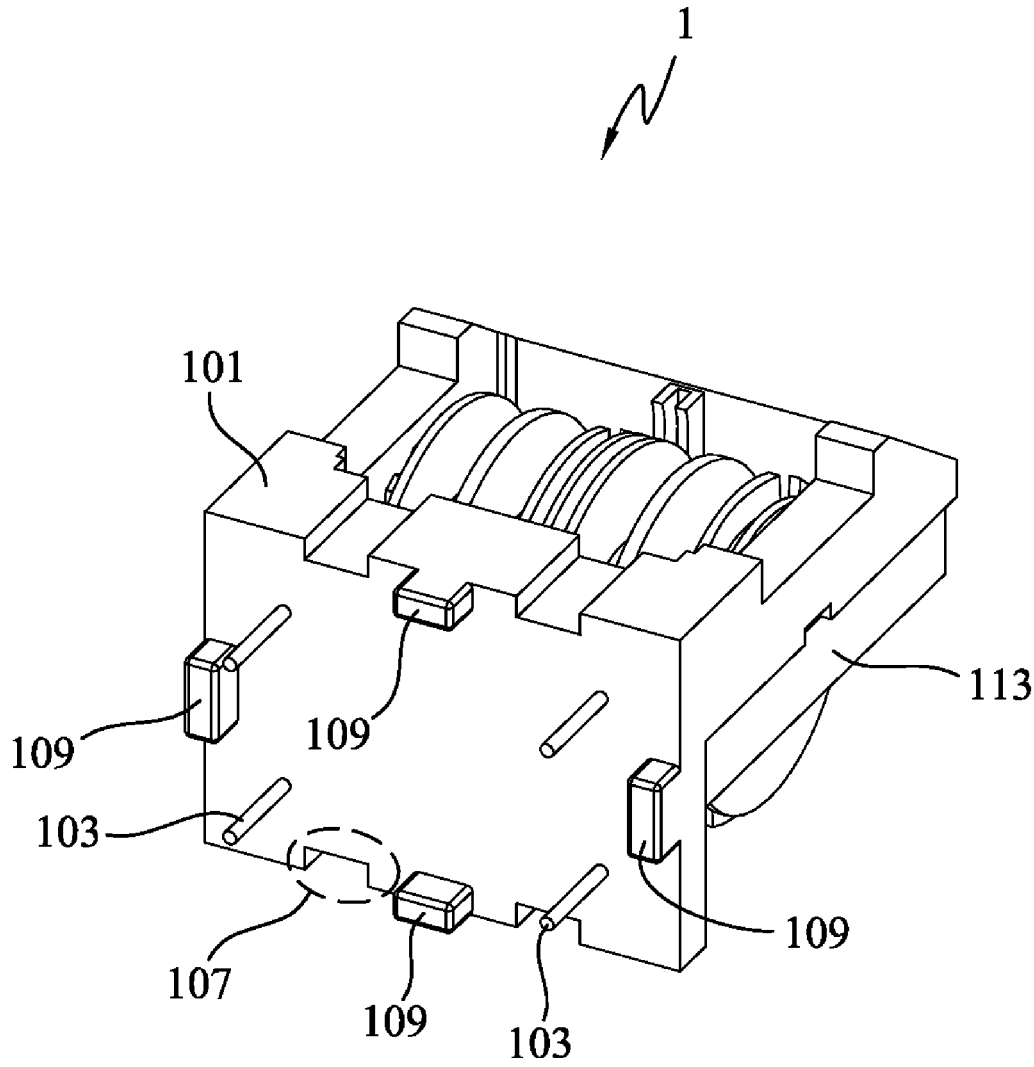
Fig. 1A (Prior Art)
FIG. 1A is a perspective view illustrating the bottom portion of the base of a conventional inductor.
Figure 1B:
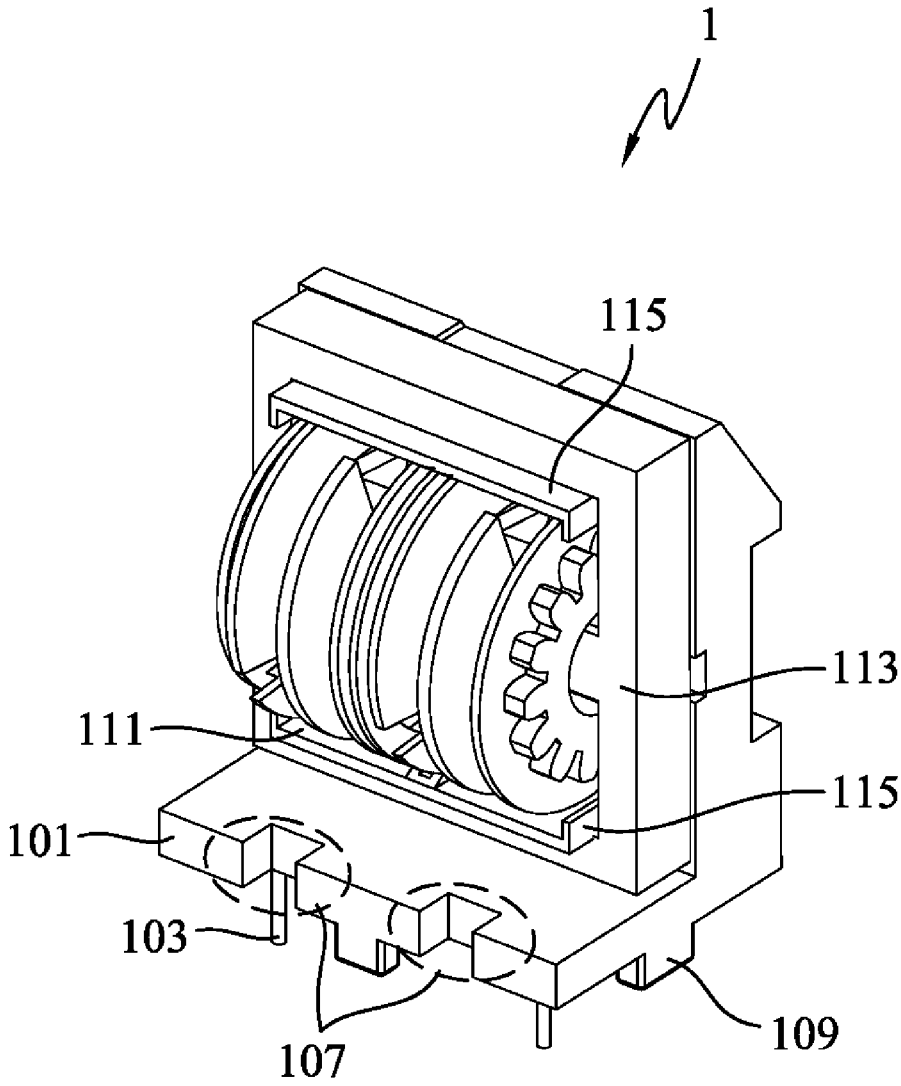
Fig. 1B (Prior Art)
FIG. 1B is a front view of the base of the conventional inductor.
Figure 1C:
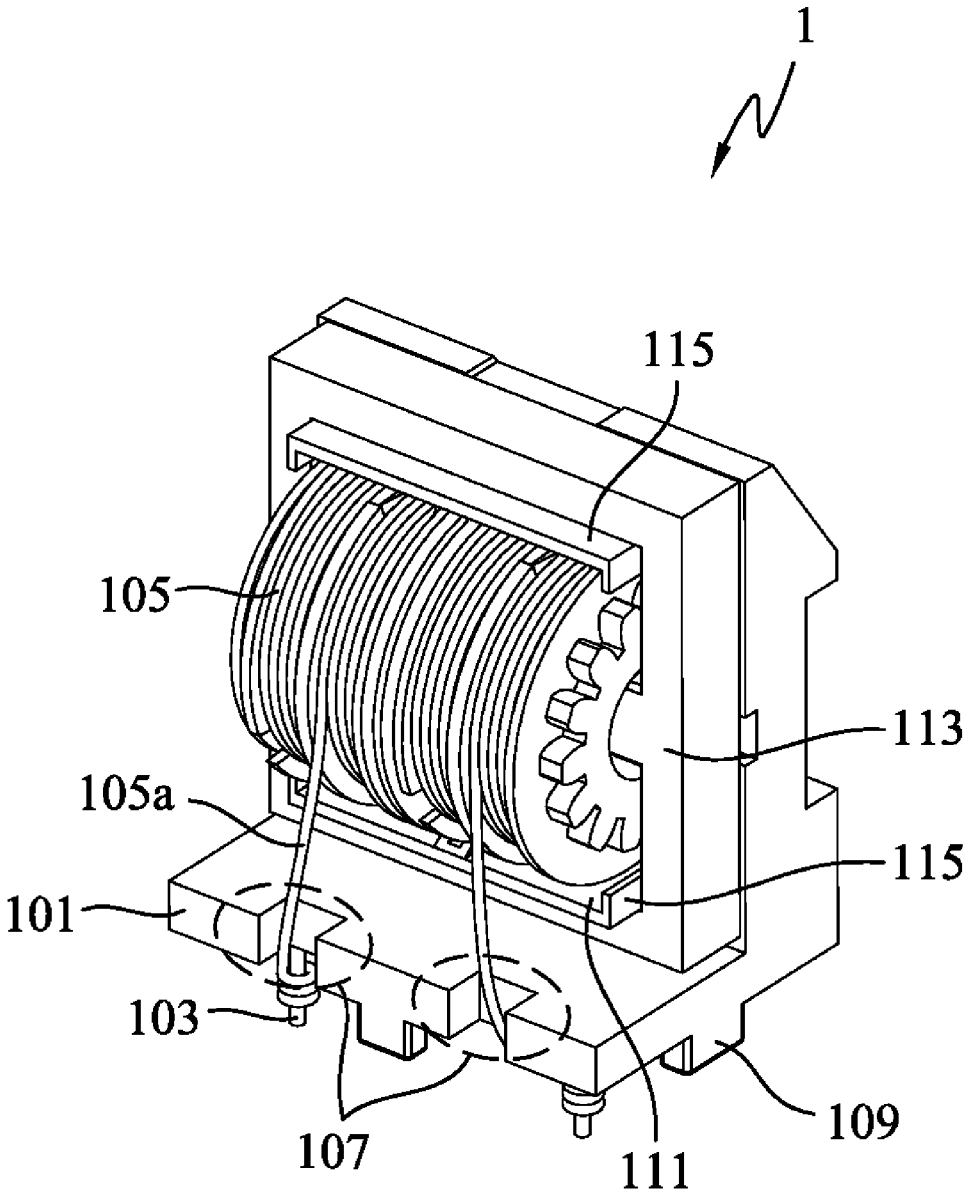
Fig. 1C (Prior Art)
FIG. 1C is a front view of the base of the conventional inductor with a coil wound thereon.
Figure 2A:
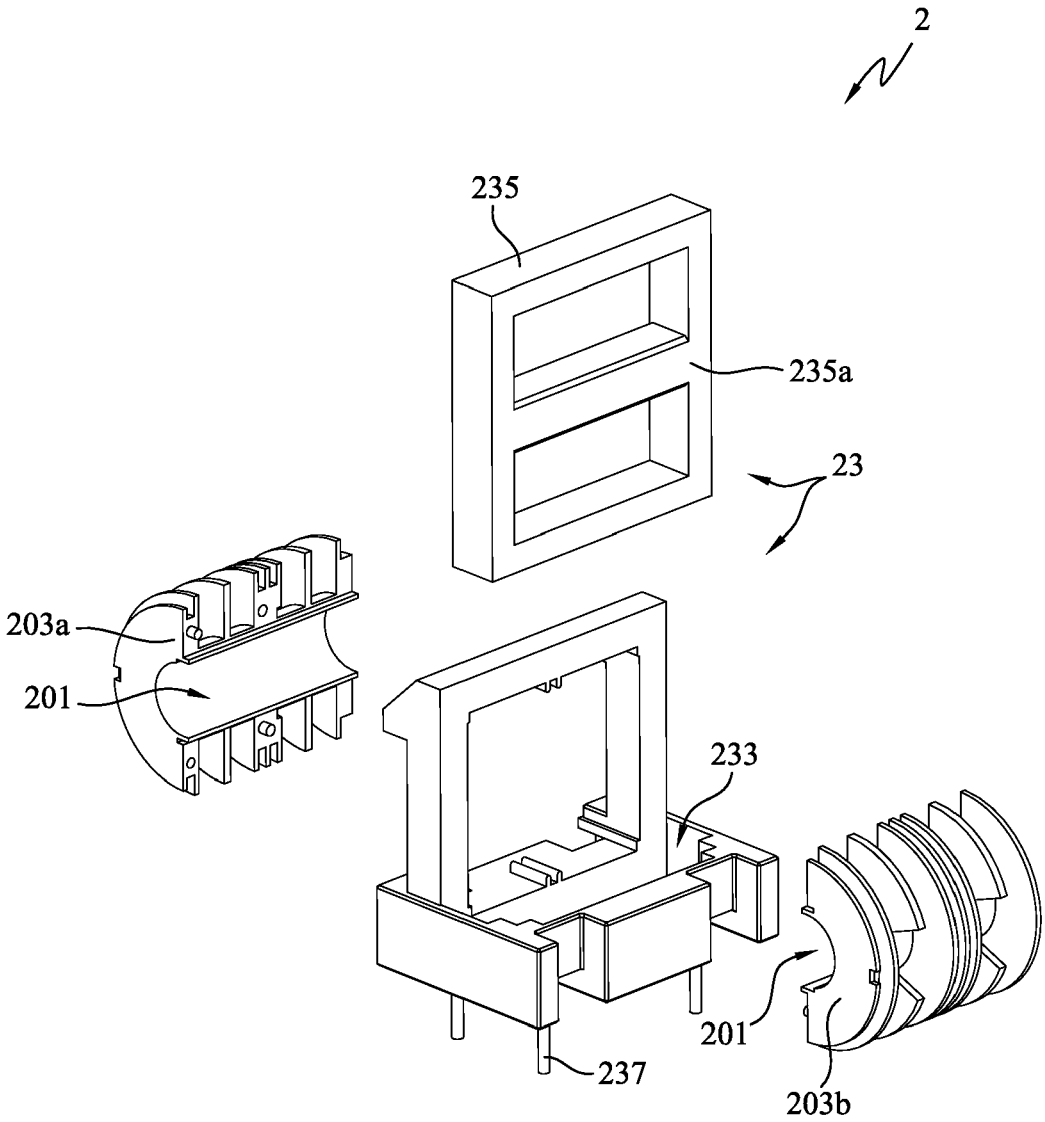
FIG. 2A is an exploded view of an inductor assembly in accordance with an embodiment of this invention.
Figure 2B:
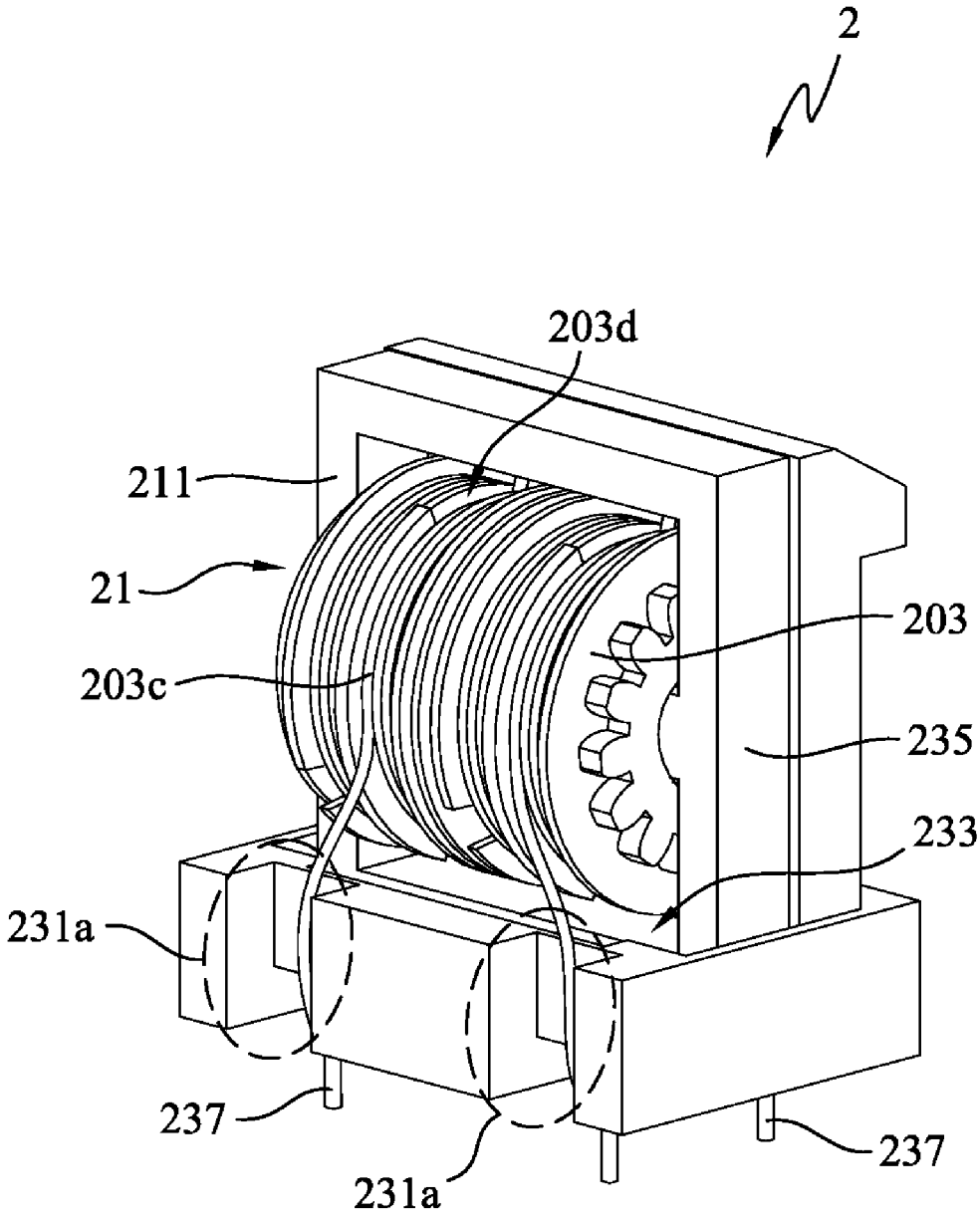
FIG. 2B is a perspective view of the inductor assembly in accordance with an embodiment of this invention.

The preferred embodiment of this invention is an inductor assembly 2, and an exploded perspective view of which is depicted in FIG. 2A. The inductor assembly 2 comprises an inductor 21 and a base 23. The inductor 21 is a filter inductor while the base 23 is a supporting base to support the filter inductor. The inductor 21 comprises an annular body, which has a hollow shaft portion 201 and a peripheral induction portion 203. The base 23 has a bottom portion 231, a recess 233, a hanging shelf 235 and four fixing pins 237.

In this embodiment, the peripheral induction portion 203 of the inductor 21 consists of the two semicircular housings 203*a*, 203*b* and a coil 203*c*. Upon assembly, the semicircular housings 203*a*, 203*b* are adapted to define a hollow shaft portion 201 therebetween to form the aforesaid annular body. Furthermore, after the semicircular housings 203*a*, 203*b* are assembled together, at least one annular groove 203*d* is formed on the housing to allow the coil 203*c* to be wound therein. In this embodiment, a copper wire may be used for the coil.

Figure 2C:
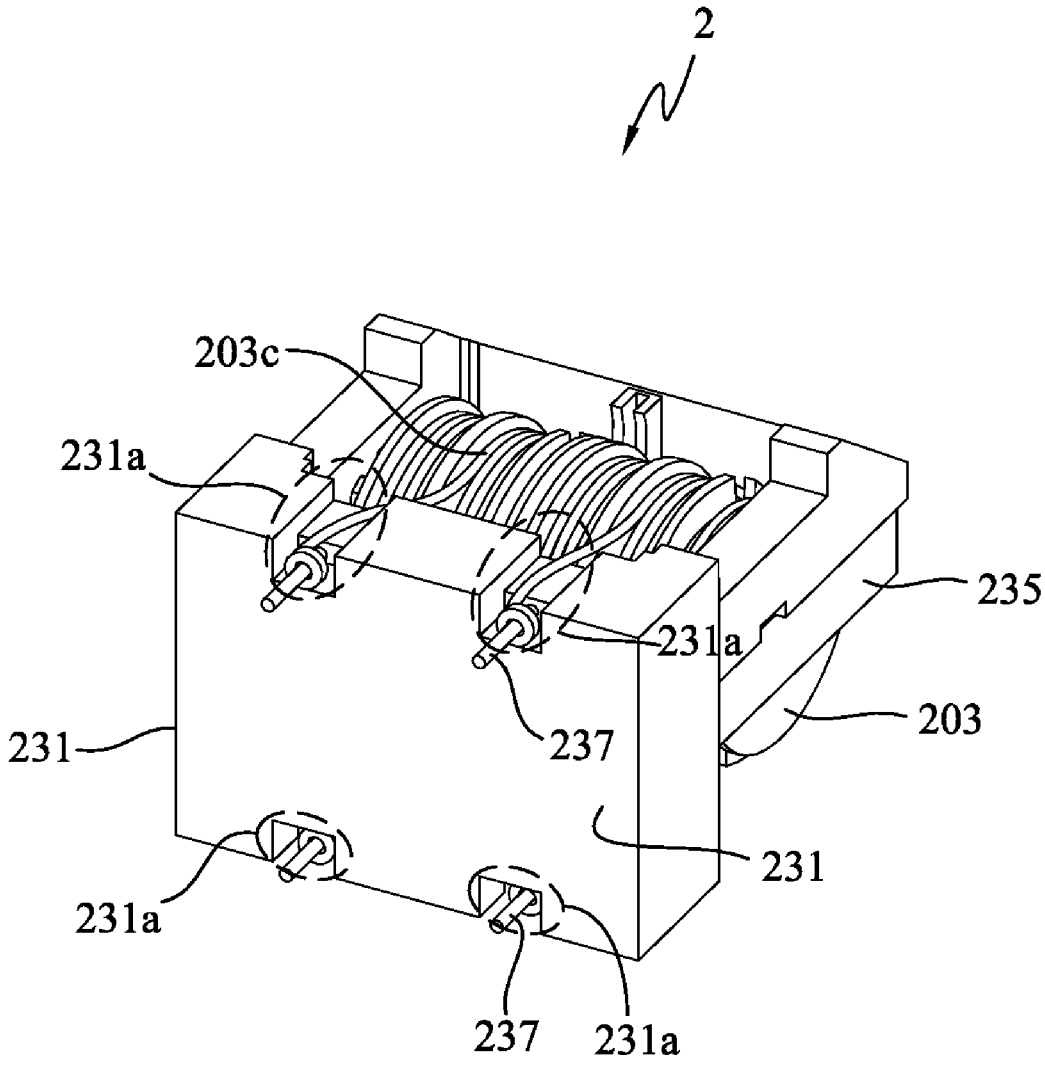
FIG. 2C is a perspective view of the inductor assembly in accordance with an embodiment of this invention from a different perspective.

As depicted in FIG. 2C, the two opposite sides of the bottom portion 231 are formed with two symmetric inward recess portions 231*a* respectively. In this embodiment, each of the inward recess portions 231*a* is formed by penetrating through a section of the side of the base 23 and further forming a recess on the bottom surface of the base 23 near the penetrating portion.

The recess 233 is formed downwardly on the bottom portion of the base 23, and the sidewall of the recess 233 is defined by an inclined surface to further match a profile of the peripheral induction portion 203 of the inductor 21. Although only a simple inclined surface is used to match the arc profile at the bottom of the peripheral induction portion 203 in this embodiment, the inclined surface may also be formed into a concave arc profile to enlarge the spacing between this inclined surface and the peripheral induction portion 203 in other embodiments. Furthermore, both sides of the recess 233 are adapted to match the bottom portion of the hanging shelf 235.

To fix the inductor assembly 2 onto a circuit board (not shown), the base 23 also comprises four fixing pins 237 for fixing purpose. As the two opposite sides of the bottom portion 231 are formed with two symmetric inward recess portions 231*a*, the four fixing pins 237 are allowed to extend downward from the interior of either the inward recess portions 231*a*. It should be noted that the number of the fixing pins 237 is not just limited to what is described above. Similarly, the locations and the arrangement of the fixing pins 237 are not just limited to the aspects described in the above embodiment. Accordingly, the locations and the number of the inclination surfaces of the recess 233 and the inward recess portions 231*a* are not just limited thereto. For example, the inclination surfaces may also be formed on both sides of the recess 233.

The hanging shelf 235 has a traverse shaft portion 235*a* formed in the central portion of the hanging shelf 235 and adapted for insertion into the hollow shaft portion 201. When the lower portion of the hanging shelf 235 is inserted in the recess 233, at least one portion of the peripheral induction portion 203 of the annular body is adapted to extend into the recess 233. More specifically, the hanging shelf 235 of this embodiment is a θ-shaped iron core.

The inductor 21 is inserted into the corresponding mounting slot of the recess 233 during the assembly, which is a very simple and highly efficient process. Moreover, the installation of the inductor assembly 2 onto the circuit board simply requires the soldering of the fixing pins 237 onto the circuit board along the penetrated side of the base 23.

In this invention, the bottom portion of the hanging shelf 235 is surrounded by the recess 233 of the bottom portion of the base 23, thereby considerably enlarging the safe distance from the bottom portion of the hanging shelf 235 to the inductor 21. Furthermore, the fixing pins 237 are led out through the inward recess portions 231*a*, and the portions of the coil 203*c* wound to the fixing pins 237 are adapted to be concealed within the inward recess portions 231*a*. Therefore, after being soldered to the fixing pin 237, the coil 203*c* will not protrude from the base 23 and thus will not contribute to the height of the bottom portion of the base 23. In this way, the base 23 of this invention can be effectively controlled in the overall height, and the fixing pins 237 of the inductor assembly 2 can be fixed onto a circuit board without the use of bosses to further meet the needs of this industry for the miniaturization of the inductor assembly 2.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A base of an inductor, wherein the inductor comprises an annular body, comprising a hollow shaft portion and a peripheral induction portion, the base comprising:

a bottom portion;

a recess, formed on the bottom portion; and a hanging shelf having a central portion, a central transverse shaft and a lower transverse shaft, in which the central transverse shaft is disposed in the central portion, the hanging shelf being adapted to be inserted in the hollow shaft portion, wherein the recess has a sidewall being defined by an inclined surface, in order that when the lower transverse shaft of the hanging shelf is fixed in the recess of the bottom portion and at least one portion of the peripheral induction portion of the annular body extends into the recess, the inclined surface of the sidewall is capable of providing profile allowing to match the peripheral induction portion.

2. The base as claimed in claim 1, further comprising at least one fixing pin, wherein a side of the bottom portion is formed with at least one inward recess portion, the at least one fixing pin extends downward from an interior of the at least one inward recess portion.

3. The base as claimed in claim 2, further comprising four fixing pins, wherein two opposite sides of the bottom portion are formed with two symmetric inward recess portions respectively, and the fixing pins extends downward from interiors of the two symmetric inward recess portions of the bottom portion.

4. The base as claimed in claim 1, wherein the peripheral induction portion has a coil.

5. The base as claimed in claim 1, wherein the hanging shelf is an iron core.

6. The base as claimed in claim 1, wherein the hanging shelf is a rectangular frame with the central transverse shaft.

* * * * *